US011793337B2

(12) United States Patent
Forsyth et al.

(10) Patent No.: US 11,793,337 B2
(45) Date of Patent: Oct. 24, 2023

(54) BEVERAGE CUP AND CLOSURE THEREFOR

(71) Applicant: KeepCup Pty Ltd, Clifton Hill (AU)

(72) Inventors: Abigail Forsyth, Clifton Hill (AU); Kate Bednarz, North Melbourne (AU); Marcus Krigsman, North Melbourne (AU); Graeme Marshall, North Melbourne (AU); Lorrin Windahl, North Melbourne (AU)

(73) Assignee: KeepCup Pty Ltd, Clifton Hill (AU)

( * ) Notice: Subject to any disclaimer, the term of this patent is extended or adjusted under 35 U.S.C. 154(b) by 324 days.

(21) Appl. No.: 17/311,830

(22) PCT Filed: May 18, 2020

(86) PCT No.: PCT/AU2020/050490
§ 371 (c)(1),
(2) Date: Jun. 8, 2021

(87) PCT Pub. No.: WO2020/232498
PCT Pub. Date: Nov. 26, 2020

(65) Prior Publication Data

US 2022/0015560 A1 Jan. 20, 2022

(30) Foreign Application Priority Data

May 22, 2019 (AU) ..... 2019901749

(51) Int. Cl.
*A47G 19/22* (2006.01)
*B65D 47/26* (2006.01)
*B65D 51/16* (2006.01)

(52) U.S. Cl.
CPC ..... *A47G 19/2272* (2013.01); *B65D 47/265* (2013.01); *B65D 51/1688* (2013.01)

(58) Field of Classification Search
CPC ..... A47G 19/2272; B65D 47/265; B65D 51/1688
(Continued)

(56) References Cited

U.S. PATENT DOCUMENTS 4,190,173 A * 2/1980 Mason ..... A47J 41/0027 222/548
6,010,029 A * 1/2000 Wang ..... B65D 47/265 222/506

(Continued)

*Primary Examiner* — James N Smalley
(74) *Attorney, Agent, or Firm* — Kearney, McWilliams & Davis, PLLC

(57) ABSTRACT

A beverage cup (20) and closure (30) assembly (10) is provided. The closure (30) includes a lid (100), an upper member (200), and a lower member (300). The lid (100) includes an aperture (130) and a drinking opening (122). The upper member (200) is located on the outside of the lid (100) and is rotatable between a first position, in which the upper member (200) covers the drinking opening (122), and a second position, in which the drinking opening (122) is unobstructed by the upper member (200). The lower member (300) is located on the inside of the lid (100) and is coupled to the upper member (200) via the aperture (130) and is rotatable by the upper member (200) between a first position, in which lower member (300) closes the drinking opening (122) and a second position in which the drinking opening (122) is unobstructed by lower member (300).

14 Claims, 9 Drawing Sheets

(58) Field of Classification Search
USPC ..... 220/253, 715
See application file for complete search history.

(56) References Cited

U.S. PATENT DOCUMENTS

| | | | | |
|---|---|---|---|---|
| 6,626,314 | B1 | 9/2003 | McHenry et al. | |
| 7,198,168 | B2 * | 4/2007 | Mizuma | B65D 17/4014 220/730 |
| 8,573,431 | B2 | 11/2013 | Shepard et al. | |
| 8,714,380 | B2 * | 5/2014 | Casale | B65D 5/029 215/297 |
| 10,252,840 | B2 | 4/2019 | Mebberson | |
| 2003/0209547 | A1 | 11/2003 | Lin | |
| 2010/0133275 | A1 | 6/2010 | Phillips | |
| 2010/0282749 | A1 | 11/2010 | Forrester | |
| 2013/0213966 | A1 * | 8/2013 | Steininger | B65D 47/265 220/253 |

* cited by examiner

BEVERAGE CUP AND CLOSURE THEREFOR

RELATED APPLICATIONS

This application is related to Australian Provisional Patent Application No. 2019901749, filed on 22 May 2019, the entire content of which is hereby incorporated by reference.

TECHNICAL FIELD

The present disclosure relates to beverage cups and, in particular, to a closure for a beverage cup.

BACKGROUND OF THE INVENTION

Disposable paper cups are widely used around the world for providing consumers with take away hot and cold beverages, particularly hot coffee and tea. These plastic lined disposable paper cups are difficult to recycle and typically end up in general waste and landfill. In order to address this problem, environmentally conscious consumers and retailers have taken to using reusable beverage cups in place of disposable cups.

Existing reusable beverage cups suffer from a number of problems and drawbacks. Many reusable beverage cups have removable lids that have a drinking opening through which the contents of the beverage cup can be consumed. In certain designs of reusable beverage cups, the drinking opening can selectively be opened and closed with a movable plug. However, when in the closed configuration, the plug is often easily dislodged resulting in inadvertent opening of the drinking opening and potential spillage. Further, even when in the closed configuration, the plug may not adequately seal the drinking opening resulting in leakage.

Furthermore, the plug mechanisms of existing reusable beverage cups are often complex, having many components, and can be difficult or impossible to take apart and reassemble. This can make the plug mechanisms difficult to clean and may result in a build-up of beverage residue, mould, and potential pathogens. Some plug mechanisms are also difficult to manufacture due to their complexity and may require glue or mechanical fixings, which are both undesirable in a reusable beverage cup.

Object of the Invention

It is an object of the present invention to substantially overcome or at least ameliorate one or more of the above disadvantages, or to provide a useful alternative.

SUMMARY OF THE INVENTION hi a first aspect, the present disclosure provides a closure for a beverage cup comprising:

a lid having an aperture and a drinking opening;

an upper member located, at least partially, on the outside of the lid, the upper member being rotatable between a first upper member position and a second upper member position;

a lower member located, at least partially, on the inside of the lid, the lower member being coupled to the upper member via the aperture and being operable by rotation of the upper member between the first and second upper member positions, the lower member being operable between a first lower member position, in which the lower member closes the drinking opening and a second lower member position in which the drinking opening is unobstructed by the lower member.

In a preferred embodiment, rotation of the upper member between the first upper member position and the second upper member position, causes the lower member to be lowered from the first lower member position away from the lid, so that the lower member is spaced from the drinking opening, and then, to be rotated away from the drinking opening to the second lower member position.

Preferably, the upper member covers the drinking opening in the first upper member position and wherein the drinking opening is unobstructed by the upper member in the second upper member position.

Preferably, the upper member includes a projection having internal helical grooves and the lower member includes a projection having external tabs that are shaped to fit within the helical grooves.

Further preferably, rotation of the upper member relative to the lower member causes the tabs to move along the helical grooves, which causes the lower member to be raised or lowered relative to the upper member.

In a preferred embodiment, the lid includes an annular projection having at least one recess and at least one circumferentially extending race adjoining the at least one recess, and the lower member includes at least one boss shaped to fit into the recess and to travel along the at least one race.

Preferably, the lower member is prevented from rotating relative to the lid when the at least one boss is located in the at least one recess and is permitted to rotate relative to the lid when the at least one boss is located in the at least one race.

In a preferred embodiment, the upper member includes at least one notch and the lower member includes at least one spring arm mechanism having a detent, wherein the detent of the spring arm mechanism is shaped to fit in the notch and thereby cause the lower member to rotate with the upper member, when the detent is located in the notch.

The lower member preferably has an upper surface that seals the drinking opening closed in the first lower member position.

Preferably, the upper surface of the lower member is provided by a sealing tab that is pressed against the drinking opening in the first lower member position to seal the drinking opening closed.

In a preferred embodiment, rotation of the upper member between the first upper member position and an intermediate position causes the lower member to be lowered relative to the lid.

Preferably, rotation of the upper member from the intermediate position to the second upper member position causes the lower member to rotate with the upper member.

In a preferred embodiment, the upper and lower members are adapted to be decoupled by holding the upper member in the second upper member position and rotating the lower member towards the first lower member position.

The closure preferably further comprises a vent in the lid that is closed by the upper member in the first upper member position and that is opened when the upper member is rotated away from the first upper member position.

In a second aspect, the present disclosure provides a beverage cup assembly comprising a beverage cup and a closure according to the first aspect.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 1:
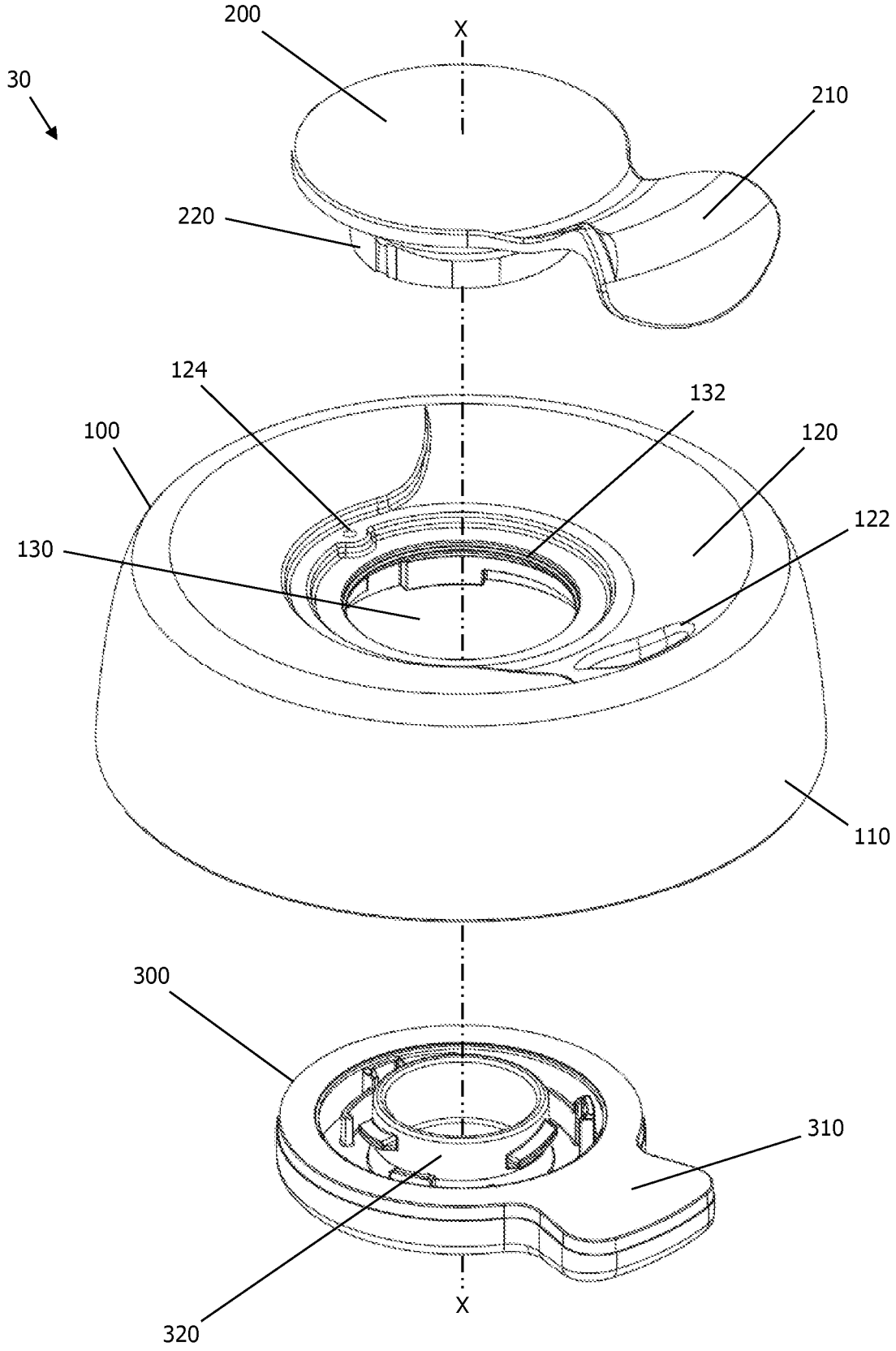
FIG. 1 is an exploded illustration of a closure for a beverage cup.
Figure 2:
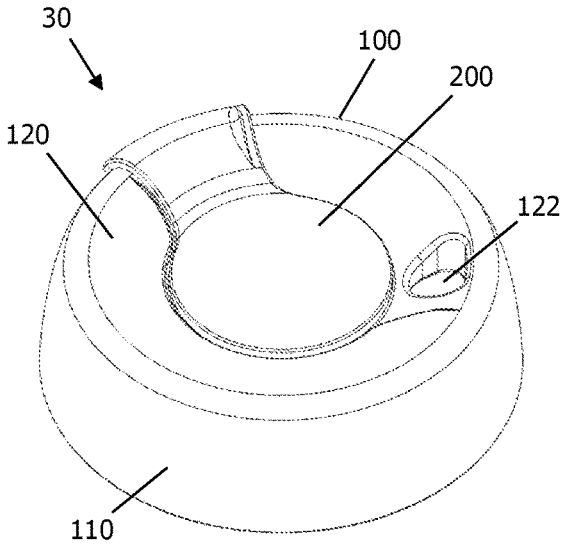
FIG. 2 depicts the closure of FIG. 1 in assembled form in an open configuration.
Figure 3:
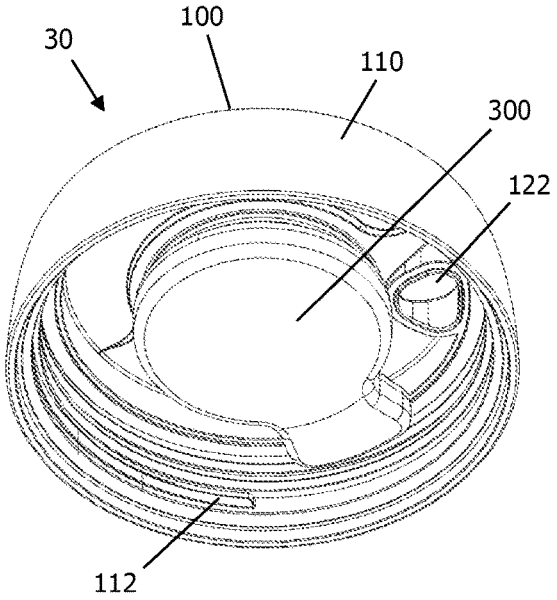
FIG. 3 depicts the closure of FIG. 2 from below.
Figure 4:
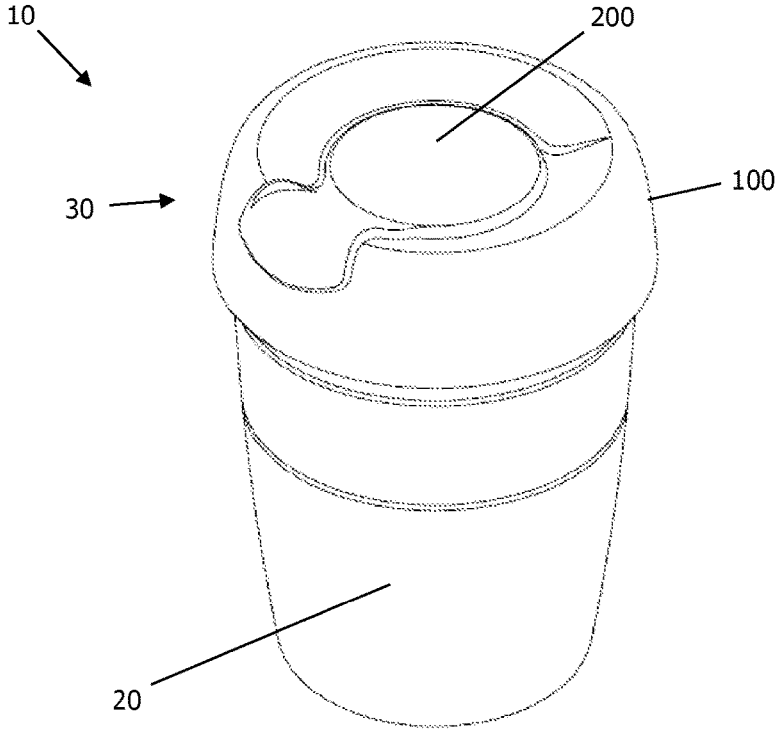
FIG. 4 illustrates a beverage cup assembly including the closure of FIG. 1.

FIG. 4 illustrates a beverage cup assembly 10 including a beverage cup 20 and a closure 30 that sealingly closes an upper opening of the beverage cup 20. The closure 30 is illustrated in isolation in FIGS. 2 and 3. FIG. 1 illustrates an exploded view of the closure 30 of FIG. 2, which includes a lid 100, an upper rotatable member 200, and a lower rotatable member 300. The upper rotatable member 200 and the lower rotatable member 300 are rotatable around a rotation axis X-X. The terms "axially", "radially", and "circumferentially" are used in this specification with reference to the axis X-X, unless the context or description indicates otherwise. The upper rotatable member 200 has a radially projecting cover tab 210 and an axially and downwardly extending annular projection 220. The lower rotatable member 300 has a radially projecting sealing tab 310 and an axially and upwardly extending annular projection 320.

The lid 100 has a top portion 120 and a downwardly depending peripheral skirt 110. The top portion 120 has a drinking opening 122 through which the contents of the beverage cup 20 may be dispensed, an air vent 124, and an aperture 130.

As shown in FIG. 3, the skirt 110 includes an internal thread 112 that engages with an external thread provided around the upper opening of the cup 20 to secure the closure 30 to the beverage cup 20 as shown in FIG. 4.

Returning to FIG. 1, when the upper rotatable member 200 and the lower rotatable member 300 are assembled to the lid 100, the upper member projection 220 and the lower member projection 320 engage with one another through the aperture 130. During use, rotation of the upper rotatable member 200 by the user selectively opens and closes the drinking opening 122, allowing the user to dispense and consume the contents of the beverage cup 20 when open and to seal the drinking opening 122 when closed. The air vent 124 allows air to enter the beverage cup 20 as the contents of the beverage cup 20 are dispensed via the drinking opening 122.

Figure 5:
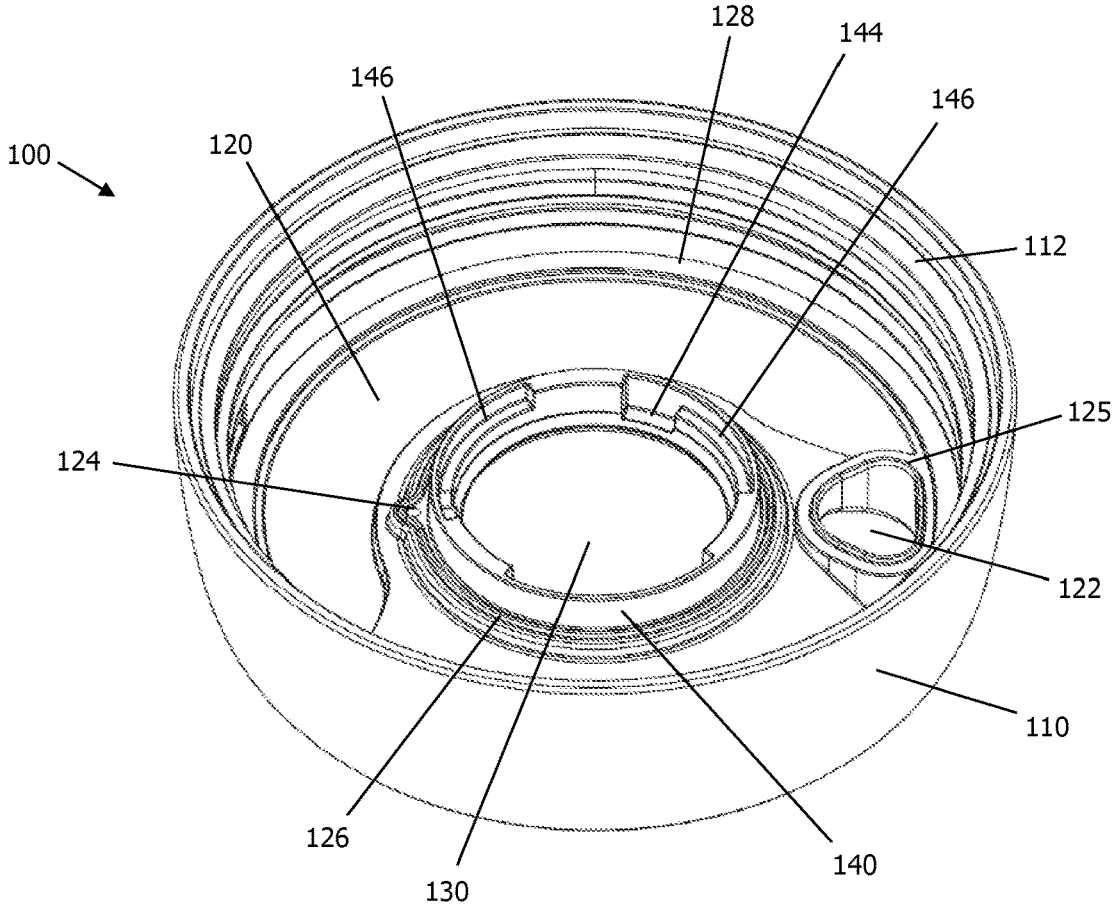
FIG. 5 depicts a lid of the closure of FIG. 1 in isolation from below.

The inside of the lid 100 is illustrated in greater detail in FIG. 5. The aperture 130 is circumferentially surrounded by an annular lid projection 140, which extends downwardly from the top portion 120 to a distal end. Recesses 144 extend upwardly towards the top portion 120 from the distal end of the lid projection 140. Each recess 144 is connected to a circumferential race 146 that extends circumferentially away from the recess 144. Each race 146 is adjacent to, and open to, the distal end of the lid projection 140. Surrounding drinking opening 122 is a raised lip 125 and on the top portion 120 of the lid 100 surrounding the lid projection 140 is a circular secondary raised lip 126. A gasket 128 extends around the periphery of the top portion 120 above the internal thread 112, which engages the top of the rim of the beverage cup 20 to provide a seal between the closure 30 and the interior of the beverage cup 20, when assembled as shown in FIG. 4.

Figure 7:
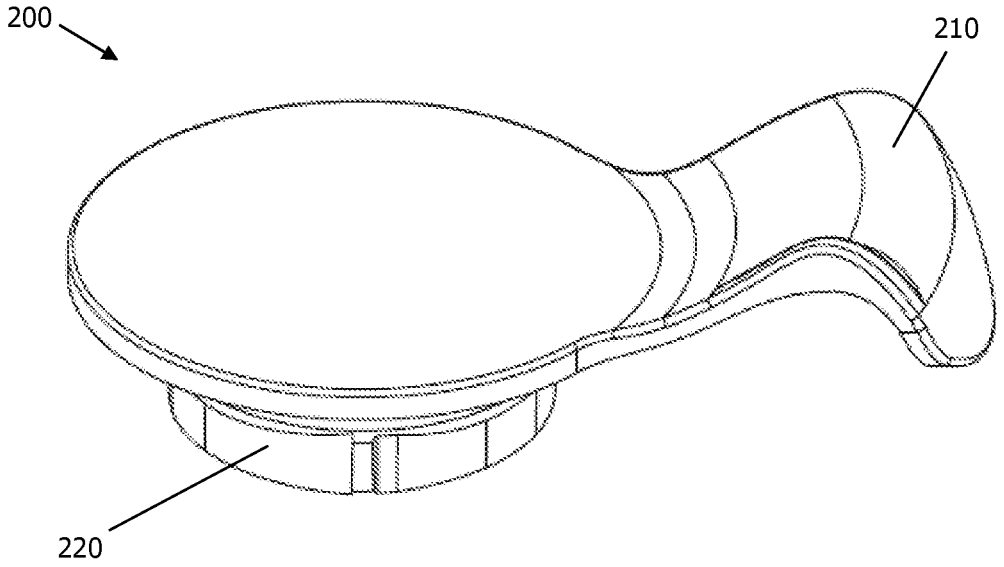
FIG. 7 depicts an upper member of the closure of FIG. 1 in isolation.
Figure 8:
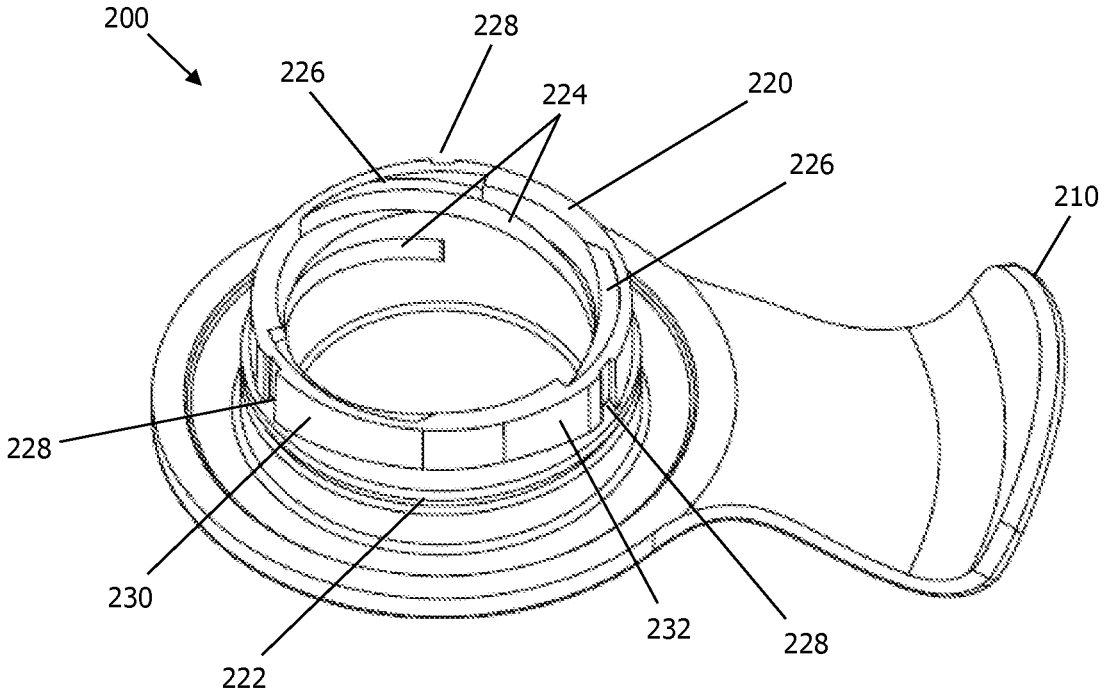
FIG. 8 depicts the upper member of FIG. 7 from below.
Figure 9:
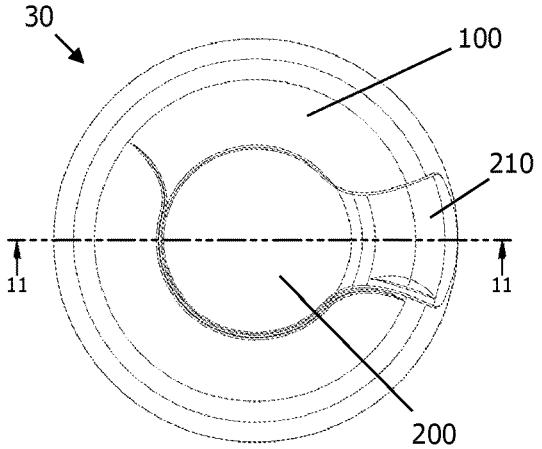
FIG. 9 is a top view of the closure of FIG. 2 in a closed configuration.
Figure 10:
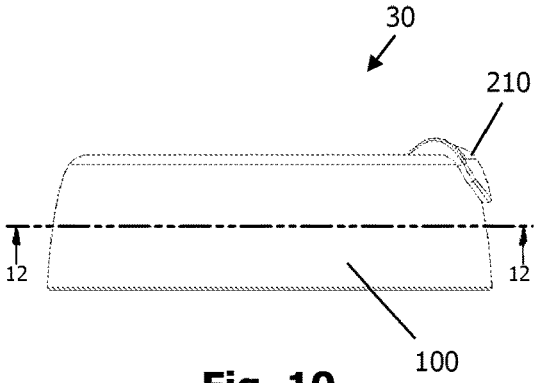
FIG. 10 is a side view of the closure of FIG. 2 in a closed configuration.
Figure 11:
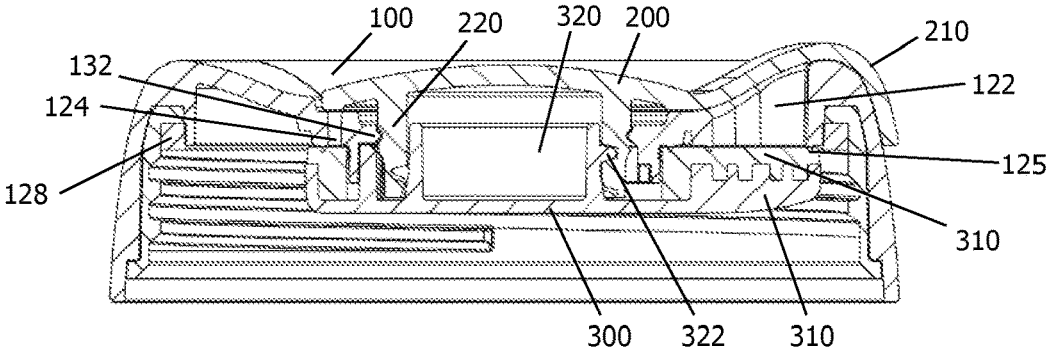
FIG. 11 is a sectional view along line 11-11 in FIG. 9.
Figure 12:
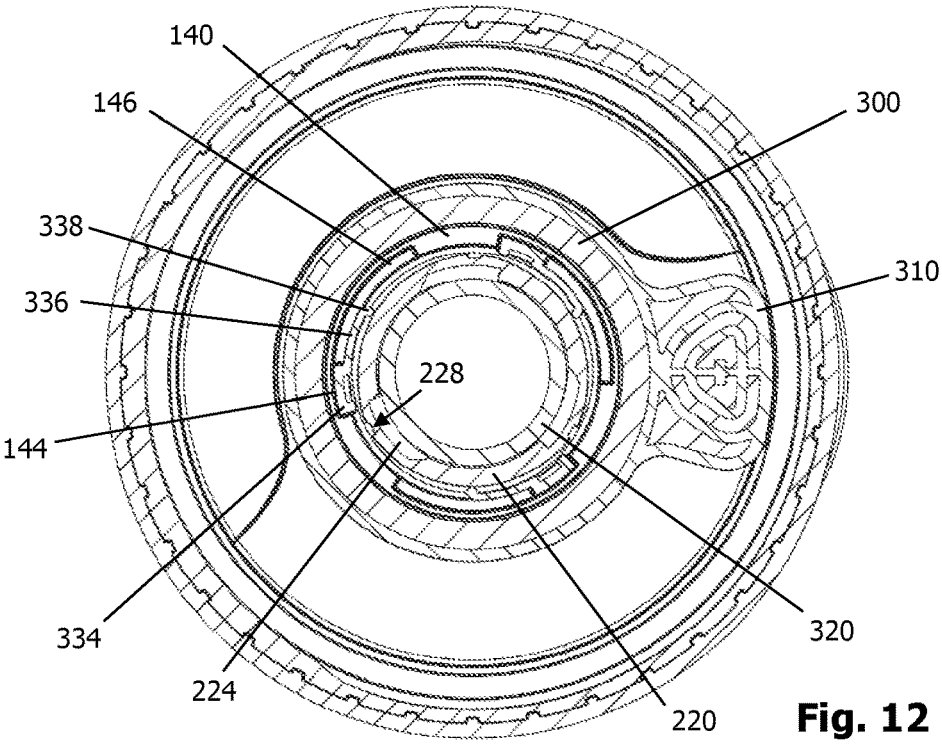
FIG. 12 is a sectional view along line 12-12 in FIG. 10.
Figure 13:
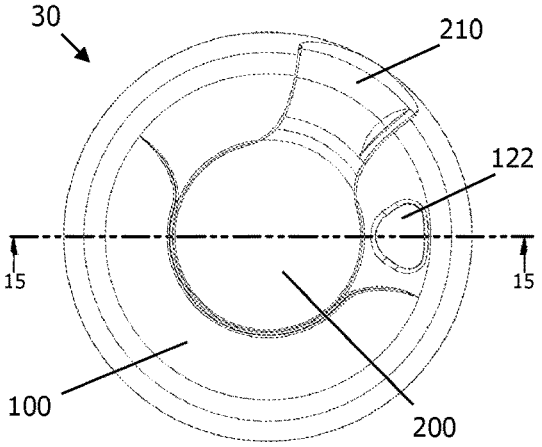
FIG. 13 is a top view of the closure of FIG. 2 in an intermediate configuration.
Figure 14:
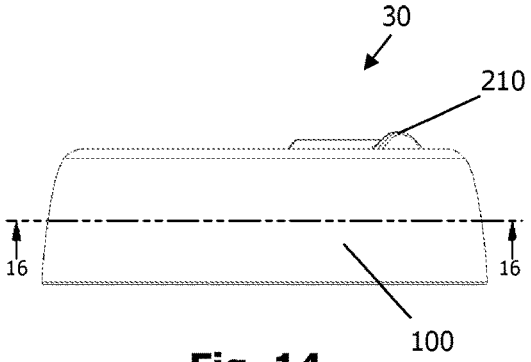
FIG. 14 is a side view of the closure of FIG. 2 in an intermediate configuration.
Figure 15:
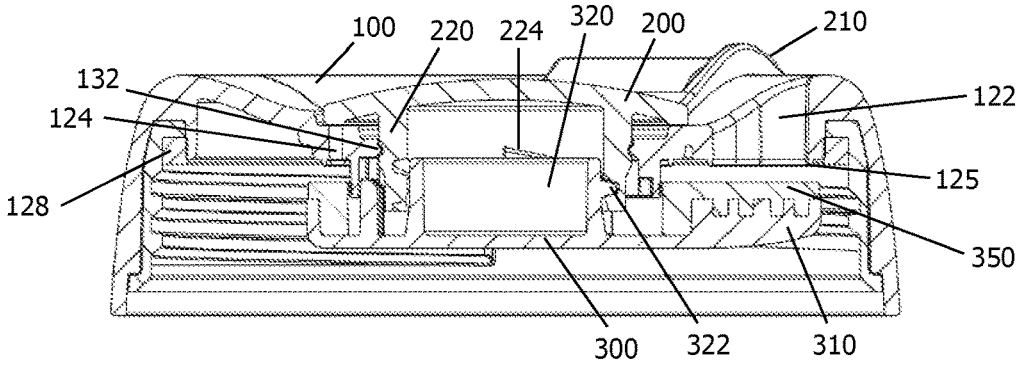
FIG. 15 is a sectional view along line 15-15 in FIG. 13.
Figure 16:
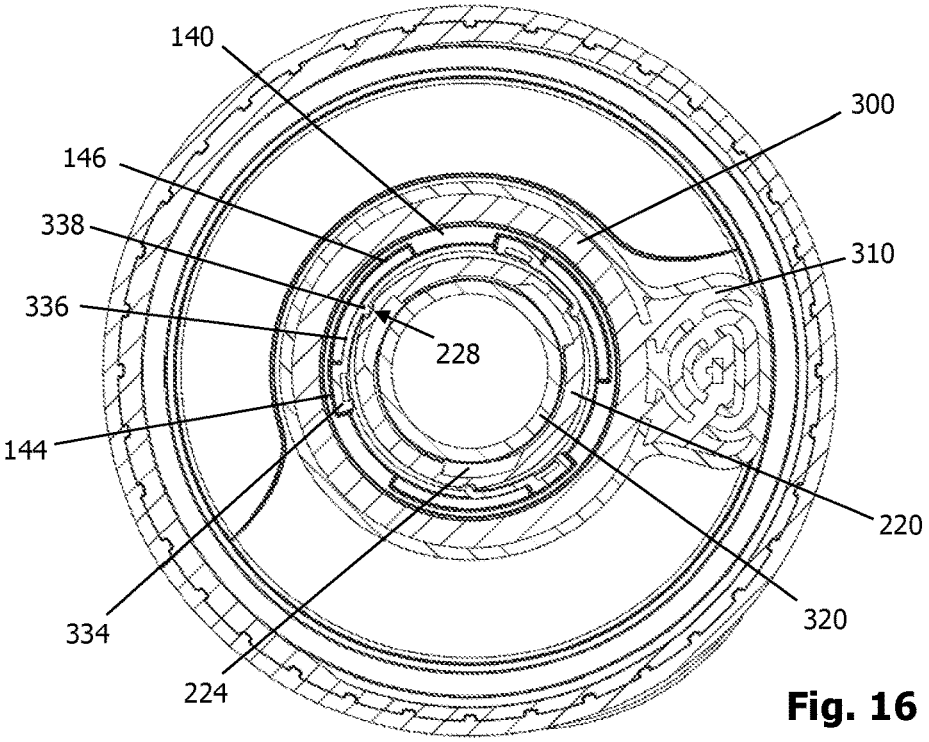
FIG. 16 is a sectional view along line 16-16 in FIG. 14.

The upper member 200 is illustrated in greater detail in FIGS. 7 and 8. The upper member projection 220 includes an internal thread provided by helical grooves 224 that commence at openings 226 at the distal end of the upper member projection 220. In the embodiment depicted, three helical grooves 224 are provided, however, in other embodiments this number may be more or less. An external circumferential groove 222 extends around the upper member projection 220 on the outside and axially extending notches 228 are circumferentially spaced around the distal end of the upper member projection 200. Circumferentially adjacent to each notch 228, the distal end of the upper member projection 220 provides a long ramp surface 230 and a short ramp surface 232 that each rise radially towards the notch 228 from opposing sides. In the embodiment depicted, three notches 228 are provided, however, in other embodiments this number may be more or less.

Figure 6:
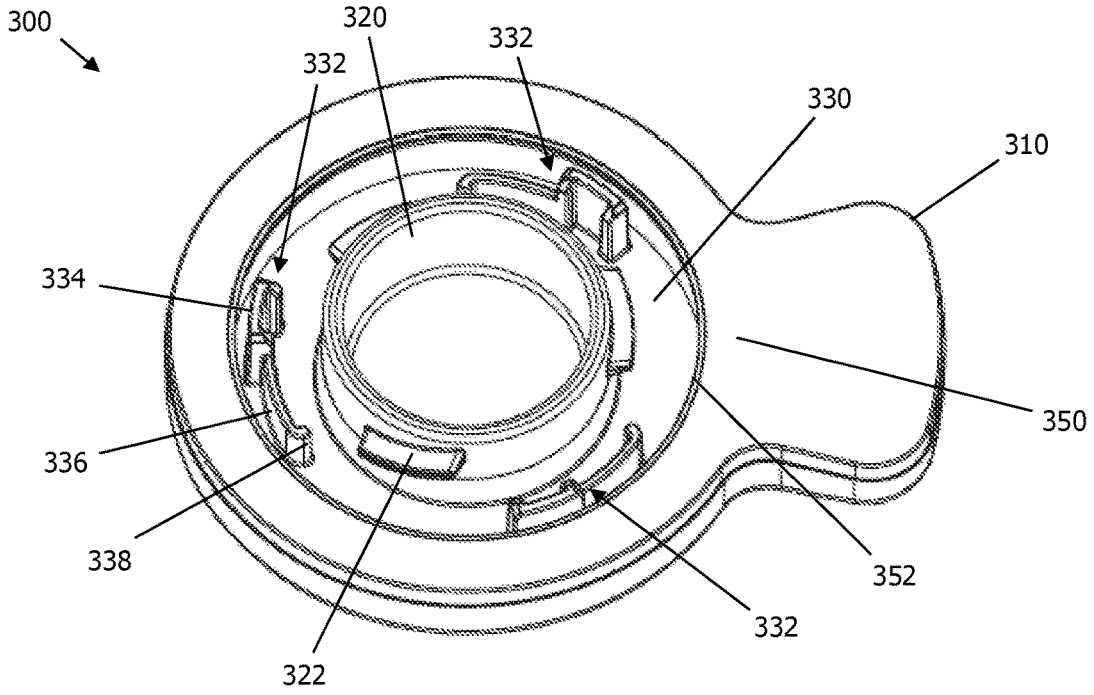
FIG. 6 depicts a lower member of the closure of FIG. 1 in isolation.

The lower member 300 is illustrated in greater detail in FIG. 6. The lower member projection 320 sits in, and projects from, an annular recess 330. Radial tabs 322 project radially from the external surface of the lower member projection 320 and are helical in shape. In the embodiment depicted, three radial tabs 322 are provided, however, in other embodiments this number may be more or less. Spring arm mechanisms 332 are located within the annular recess 330 and include a boss portion 334 that projects from the base of the annular recess 330 and a spring arm 336 that extends generally circumferentially from the boss portion 334 to an inward detent 338 at a distal end of the spring arm 336. In the embodiment depicted, three spring arm mechanisms 332 are provided, however, in other embodiments this number may be more or less. An upper surface 350 of the lower member 300 has a seal overmould, which is typically formed from a rubberised thermoplastic elastomer (TPE) material or a thermoplastic rubber (TPR) material, and extends around the periphery of the annular recess 330 and over the sealing tab 310. Formed as part of the overmoulded upper surface 350, is an annular wiper seal 352 projecting radially inwardly.

Figure 24:
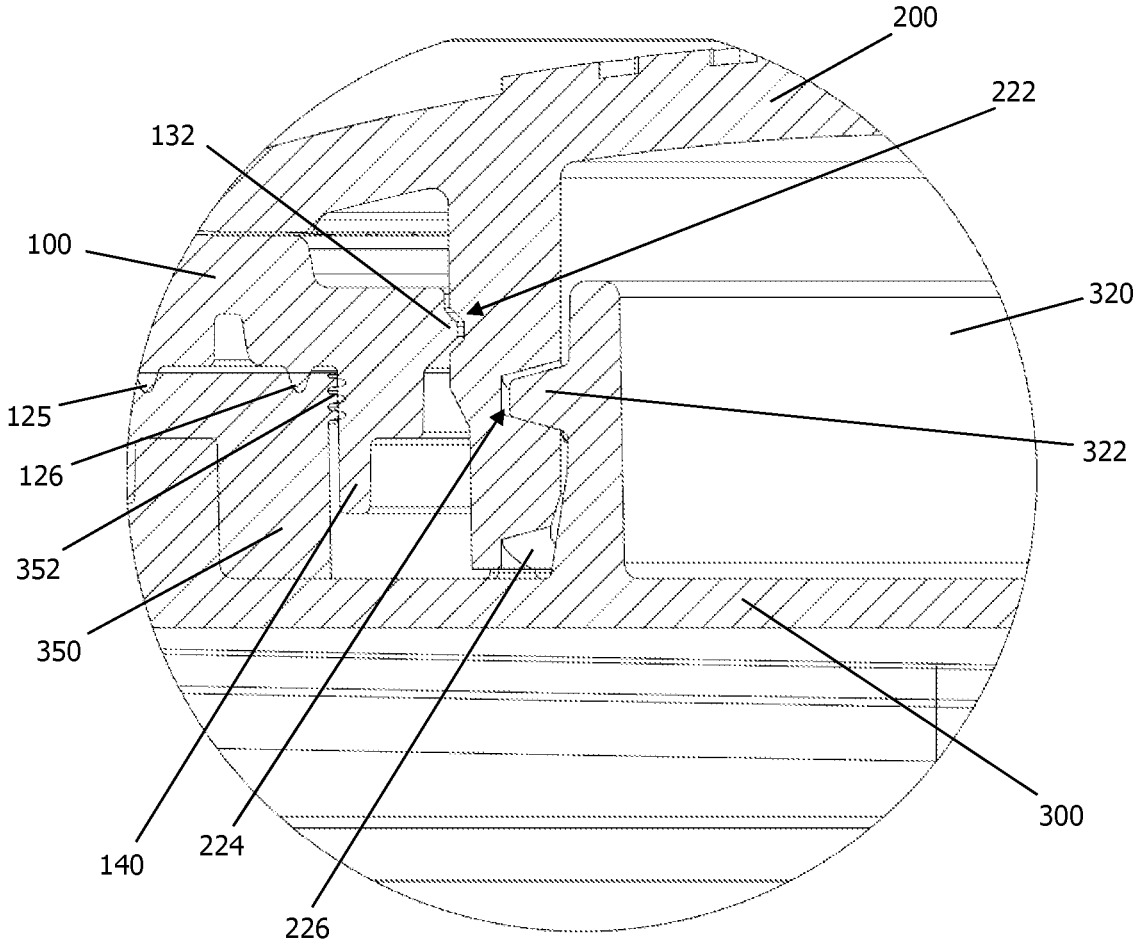
FIG. 24 is an enlarged detail view of the area labelled A in FIG. 23.

In order to assemble the closure 30, the upper rotatable member 200 is pressed into the aperture 130 of the lid 100. In order to affect the press fit, the aperture 130 has a radially projecting rib 132, or lip, which is complementary to the circumferential groove 222 of the upper member projection 220. When the upper member projection 220 is pressed into the aperture 130, the rib 132 snaps into the circumferential groove 222, retaining the upper member 200 on the lid 100, while allowing axial rotation of the upper member 200 relative to the lid 100. This fit is best illustrated in FIG. 24.

Figure 21:
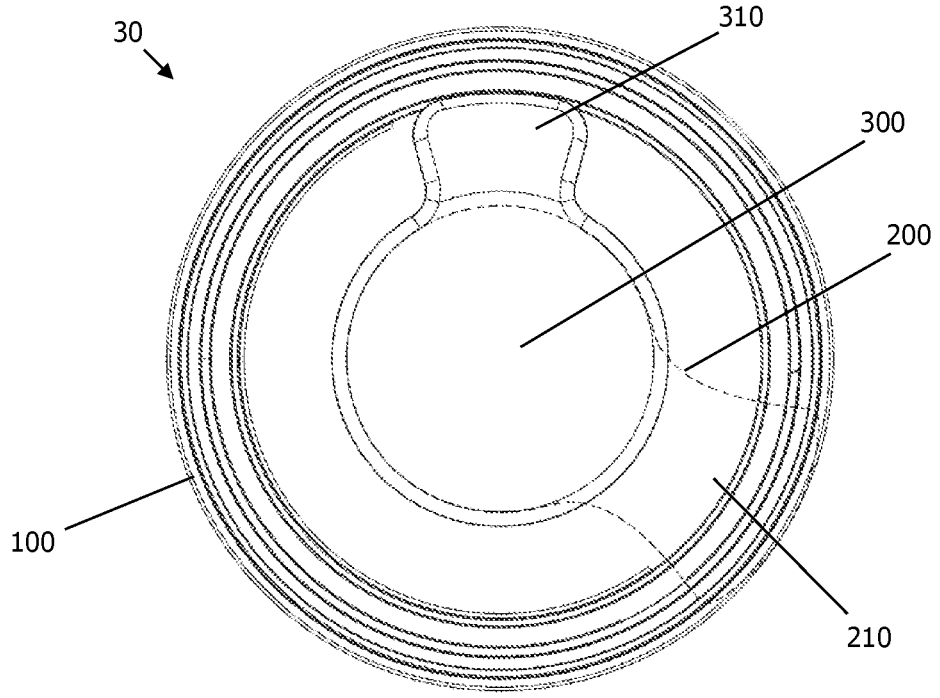
FIG. 21 illustrates the closure of FIG. 2 during assembly.
Figure 22:
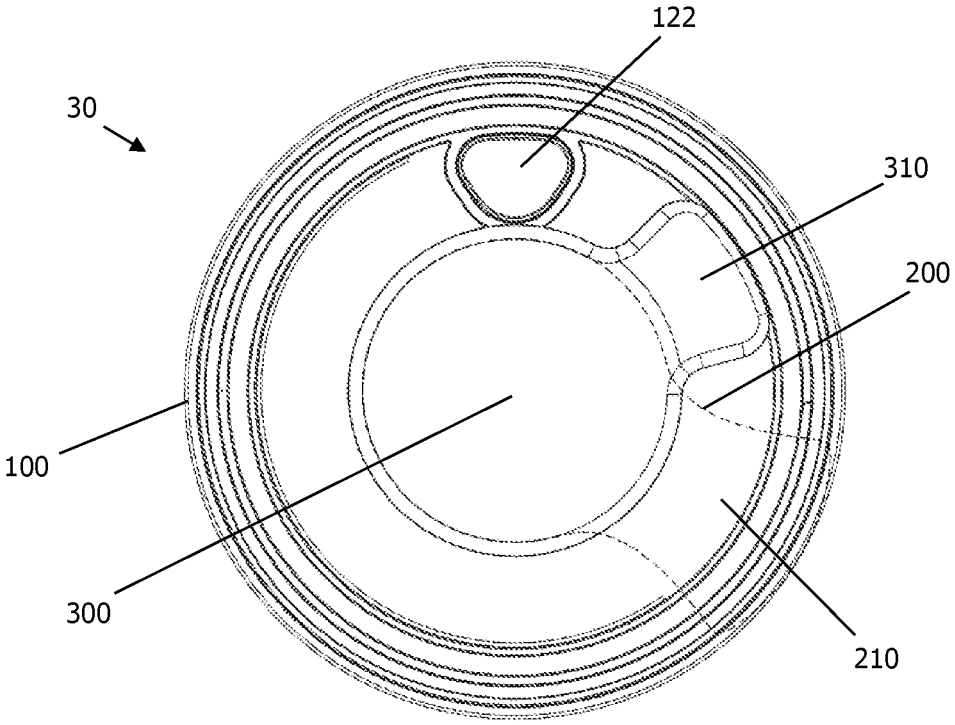
FIG. 22 illustrates the closure of FIG. 2 following assembly in the open configuration.
Figure 23:
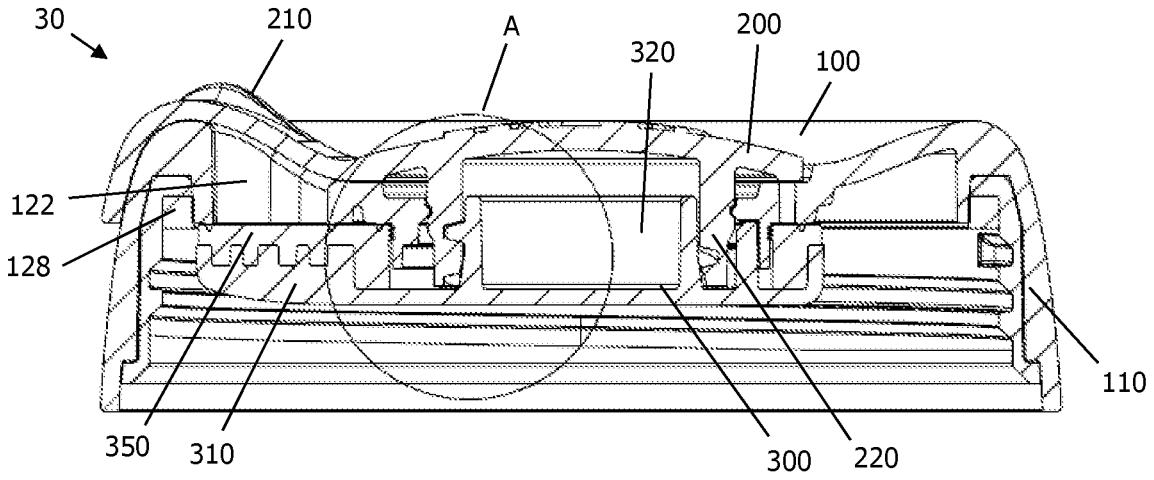
FIG. 23 is a cross-sectional view of the closure of FIG. 2 in the closed configuration.

Referring now to FIGS. 21 and 22, the upper member 200 (shown in hidden detail) is rotated relative to the lid 100 to a position in which the cover tab 210 is angularly offset from alignment with the drinking opening 122 by an angle of 120°. The lower member 300 is then pressed upwardly into the upper member projection 220 in an orientation in which the sealing tab 310 is aligned with the drinking opening 122. In this position, which is illustrated in FIG. 21, the radial tabs 322 are located in the openings 226 of the helical grooves 224 and the boss portions 334 of the spring arm mechanisms 332 are located below the recesses 144 in the lid projection 140.

Referring now to FIG. 22, the lower member 300 is rotated relative to the lid 100 to a position in which the sealing tab 310 is angularly offset from alignment with the drinking opening 122, in the same direction as the cover tab 210, by an angle of 60°. During this rotation, the radial tabs 322 travel along the helical grooves 224, drawing the lower member projection 320 further into the upper member projection 220. This draws the boss portion 334 of each spring arm mechanism 332 gradually into and along the corresponding race 146 in the lid projection 140 until the boss portion 334 is located at the distal end of the race 146. At the same time, the detent 338 of each spring arm mechanism 332 runs up the corresponding short ramp surface 232 deforming the spring arm 336 outwardly until it reaches the corresponding notch 228 and the detent 338 snaps into the notch 228 by way of the elastic force of the deformed spring arm 336. This corresponds to the open position depicted in FIGS. 22 and FIGS. 17 to 20, in which the upper member 200 is rotated relative to the lid 100 to a position in which the cover tab 210 is angularly offset from alignment with the drinking opening 122 by an angle of 120° and the lower member 300 is rotated relative to the lid 100 to a position in which the sealing tab 310 is angularly offset from alignment with the drinking opening 122, in the same direction as the cover tab 210, by an angle of 60°. In this fully open position, the sealing tab 310 remains vertically spaced from the top portion 120 of the lid 100.

In order to close the drinking opening 122, the upper member 200 is first rotated to the intermediate position depicted in FIGS. 13 to 16. With the detents 338 located in the notches 228, as the cover tab 210 of the upper member 200 is rotated towards the drinking opening 122, the lower member 300 is urged to rotate together with the upper member 200, maintaining the angular offset of the cover tab 210 and the sealing tab 310 at 60°. As the upper member 200 is rotated to the intermediate position, the boss portion 334 of each spring arm mechanism 332 travels along the corresponding race 146 in the lid projection 140 until the boss portion 334 is located below the corresponding recess 144, where it abuts against the wall of the race 146. This is evident from a comparison of FIG. 20, in which the boss portions 334 are located at the distal end of the corresponding races 146, and FIG. 16, in which the boss portions 334 are located below the recesses 144 at the opposite end of the corresponding races 146. In this intermediate position, the sealing tab 310 is angularly aligned with, but remains vertically spaced from, the drinking opening 122.

In order to continue closing and seal the drinking opening 122, the upper member 200 is further rotated to the closed position depicted in FIGS. 9 to 12. Because each boss portion 334 is abutting the wall at the end of the corresponding race 146, the lower member 300 can no longer rotate in unison with the upper member 200. This forces the detents 338 to each pop out of the corresponding notch 228 and run circumferentially over the long ramp surface 230 away from the notch 228, as the upper member 200 is rotated. The relative rotation of the upper member 200 to the lower member 300 also causes the helical grooves 224 to rotate relative to the radial tabs 322, which has the effect of drawing the lower member 300 upwards relative to the upper member 200 and lid 100. As the lower member 300 is drawn upwards, the boss portions 334 are drawn upwardly into the corresponding recesses 144 and this has the effect of rotationally locking the lower portion 300 relative to the lid 100. In this way, when the upper member 200 has been rotated to the closed position depicted in FIGS. 9 to 12, the lower member 300 has been drawn upwardly such that the sealing tab 310 is pressed against the drinking opening 122 and the annular portion of the upper surface 350 of the lower member 300 is pressed against the underside of the top portion 120 of the lid. In this position, the first raised lip 125 around the drinking opening 122 presses into the upper surface 350 of the sealing tab 310 and the secondary raised lip 126 on the top portion 120 of the lid 100 presses into the annular portion of the upper surface 350 of the lower member 300. This seals the drinking opening 122 closed and prevents the contents of the beverage cup 20 from spilling or leaking from the drinking opening 122.

Figure 17:
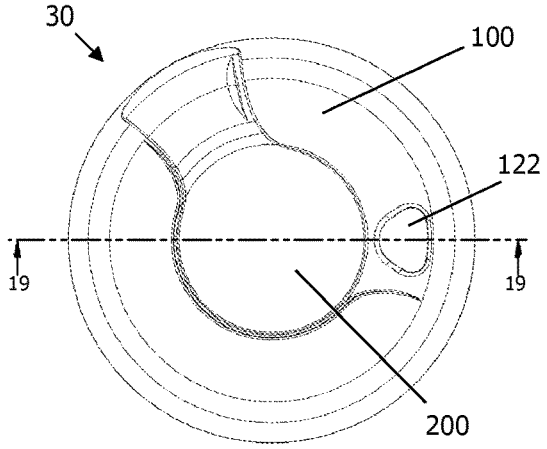
FIG. 17 is a top view of the closure of FIG. 2 in an open configuration.
Figure 18:
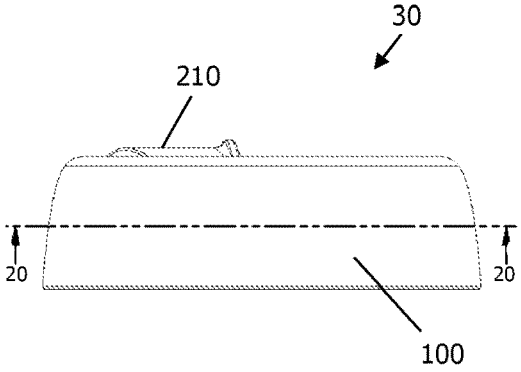
FIG. 18 is a side view of the closure of FIG. 2 in an open configuration.
Figure 19:
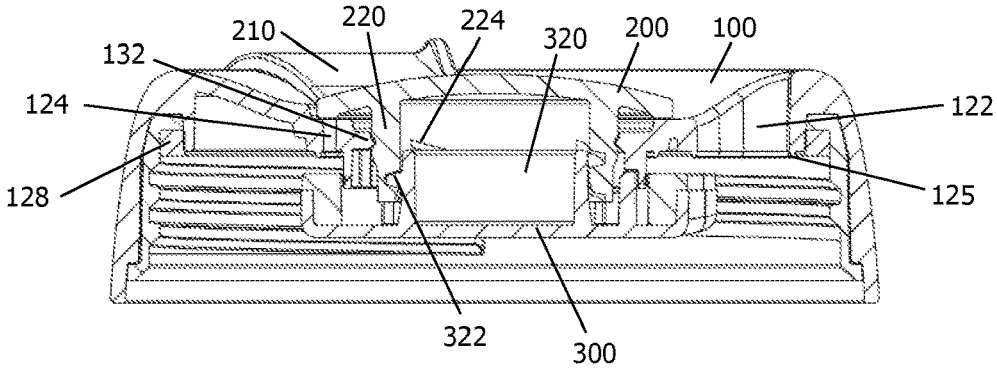
FIG. 19 is a sectional view along line 19-19 in FIG. 17.
Figure 20:
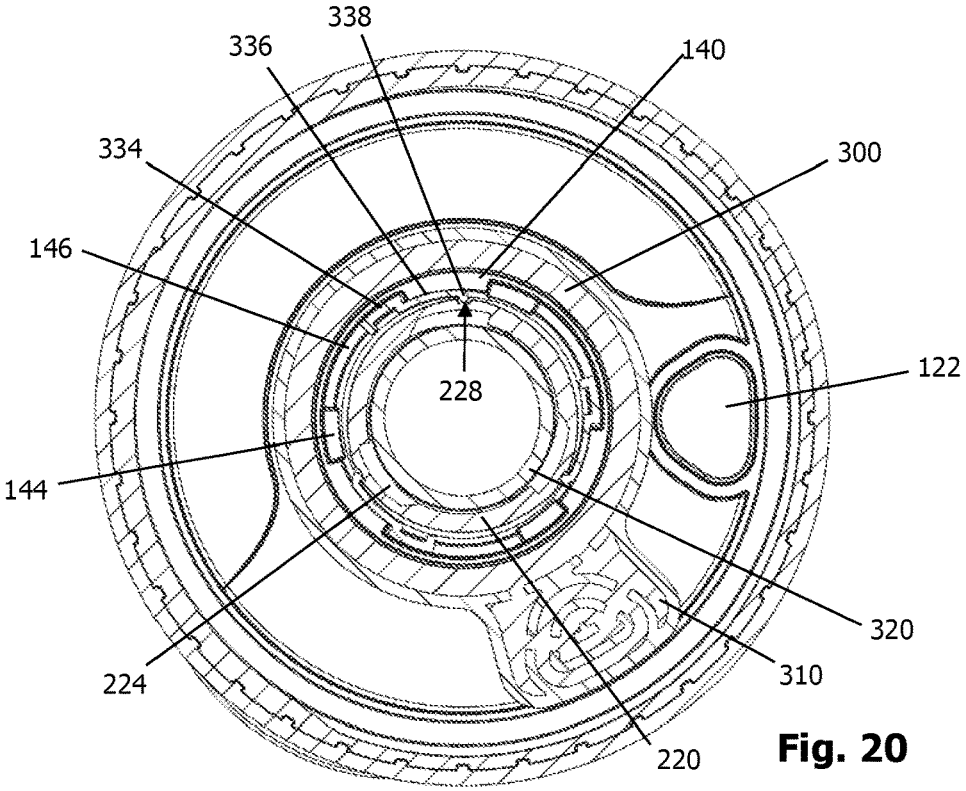
FIG. 20 is a sectional view along line 20-20 in FIG. 18.

In order to open the drinking opening 122, the above process is reversed by rotating the upper member 200 from the closed position (FIG. 9), through the intermediate position (FIG. 13), to the open position (FIG. 17).

As the upper member 200 is rotated from the closed position to the intermediate position, the lower member 300 remains rotationally locked relative to the lid 100 by the boss portions 334 being located in the recesses 144. As rotation of the upper member 200 continues, the lower member 300 is drawn downwards by the relative rotation of the helical grooves 224 over the radial tabs 322 and the detents 338 of the spring arm mechanisms 332 each run circumferentially over the long ramp surface 230 towards the corresponding notch 228. This continues until, in the intermediate position, the boss portions 334 are lowered out of the recesses 144 and into the races 146 and the detents 338 are located in the corresponding notches 228.

As the upper member 200 is further rotated through the intermediate position to the open position, the lower member 300 is urged to rotate in unison with the upper member 200 by the detents 338 being located in the notches 228 and the lower member 300 is free to rotate relative to the lid 100 because the boss portions 334 are removed from the recesses 144 and able to move along the races 146 in the lid projection 140. This rotates the sealing tab 310 away from the drinking opening 122 and continues until, in the open position, the sealing tab 310 is angularly offset to the drinking opening 122 by an angle of 60° and the cover tab 210 is angularly offset to the drinking opening 122 by an angle of 120°.

In order to disassemble the closure 30, in the open position, the lower member 300 is forced to rotate towards the drinking opening 122, while the upper member 200 is held in place on the lid 100 by the user. This forces the detents 338 to pop out of the recesses 228 and travel along the corresponding short ramp surface away from the recess 228. As the lower member 300 rotates relative to the lid 100, the boss portions 334 are free to travel back along the races 146 towards the end adjacent the corresponding recess 144. Meanwhile, the rotation of the lower member 300 relative to the upper member 200 causes the radial tabs 322 to travel further along the helical grooves 224, causing the lower member 300 to lower relative to the upper member 200 and lid 100, until the radial tabs 322 reach the openings 226 of the helical grooves 224. At that point, the lower member 300 is detached from the upper member 200 and can be removed and the closure 30 can be completely disassembled by pressing the upper member projection 220 out of the aperture 130, thereby detaching the upper member 200 from the lid 100.

While the preferred embodiment described has components being angularly offset by an angle of 60° or 120° from alignment with the drinking opening 122 in certain configurations, other embodiments may involve greater or smaller angular offsets in order to perform a similar function.

In the open position, the drinking opening 122 is completely free from obstruction and the contents of the beverage cup 20 can be easily poured from the drinking opening 122. At the same time, the air vent 124 is in open communication with the interior of the beverage cup 20 allowing air into the beverage cup 20 as the contents are poured from the drinking opening 122. This pressure equalisation is important when a user is drinking through the drinking opening 122 as without the air vent 124 the beverage will not flow out of the drinking opening 122 without either air passing back through the drinking opening 122 into the beverage cup 20 or deformation of the beverage cup 20 or closure 30. In this position, the annular wiper seal 352 is pressed against the outer surface of the lid projection 140, which circumferentially seals the lower member 300 against the lid 100, preventing the contents of the beverage cup 20 from seeping between the lid 100 and lower member 300 and into the mechanism at the interface of the upper member 200 and lower member 300.

In the closed position, the periphery of the drinking opening 122 is sealed by the lip 125 of the drinking aperture 122 pressing into the upper surface 350 of the lower member 300. Further, the periphery of the lid projection 140 is sealed by the secondary raised lip 126 on the top portion 120 of the lid 100 pressing into the upper surface 350 of the lower member 300. Furthermore, as with the open position, the annular wiper seal 352 is pressed against the outer surface of the lid projection 140, as best shown in FIG. 24. Together with the secondary raised lip 126, this circumferentially seals the lower member 300 against the lid 100, preventing the contents of the beverage cup 20 from seeping between the lid 100 and lower member 300 and into the mechanism at the interface of the upper member 200 and lower member 300. This completely seals the closure 30 and prevents leakage of the contents.

The upper surface 350 of the lower member 300 comprises a deformable sealing material overmoulded onto the lower member 300. Overmoulding allows two materials to be joined without the use of adhesives. In general, overmoulding utilises an initial substrate, which may or may not have been moulded, with a second material being moulded over the top of the initial substrate. The overmoulding process generally utilises mechanical interlocks to create a single part in which the materials are not separable without first breaking the interlock. Examples of suitable overmoulded materials include Santoprene™, Infuse™ and other deformable and/or flexible and/or elastic materials including forms of silicon and rubber.

The beverage cup 20 and lid 100 may be formed from a metal such as stainless steel or various polymers or copolymers, such as a thermoset or a thermoplastic. Alternatively, the beverage cup 20 may be formed from glass. The upper member 200 and lower member 300 are typically formed from a polymer or copolymer, such as a thermoset or a thermoplastic. Typical polymeric materials for these purposes include substantially rigid materials, such as polypropylene, polypropylene-copolymer, polyethylene (LDPE or HDPE), acrylonitrile butadiene styrene (ABS) or a polyamide (e.g. Nylon), allowing a more rigid body structure for the various components.

The embodiment described above provides a user with a closure 30 for a beverage cup 20 that has a drinking opening 122 that can be easily and securely sealed and that helps prevent leakage from the closure 30. The opening and closing mechanism is simple to operate, provides a very effective seal when closed, and is also simple to disassemble and reassemble so that the components can be cleaned. The closure 30 has only three separate components and requires no gluing or fixing of components, which facilitates manufacturing and assembly and makes maintenance of the closure 30 very user friendly, and is more hygienic.

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Although the invention has been described with reference to specific examples, it will be appreciated by those skilled in the art that the invention may be embodied in many other forms.

The invention claimed is:

1. A closure for a beverage cup comprising:

a lid having an aperture and a drinking opening;

an upper member located, at least partially, on the outside of the lid, the upper member being rotatable between a first upper member position and a second upper member position; and a lower member located, at least partially, on the inside of the lid, the lower member being coupled to the upper member via the aperture and being operable by rotation of the upper member between the first and second upper member positions, the lower member being operable between a first lower member position, in which the lower member closes the drinking opening and a second lower member position in which the drinking opening is unobstructed by the lower member;

wherein rotation of the upper member between the first upper member position and the second upper member position, causes the lower member to be lowered from the first lower member position away from the lid, so that the lower member is spaced from the drinking opening, and then, to be rotated away from the drinking opening to the second lower member position.

2. The closure of claim 1, wherein the upper member covers the drinking opening in the first upper member position and wherein the drinking opening is unobstructed by the upper member in the second upper member position.

3. The closure of claim 1, wherein the upper member includes a projection having internal helical grooves and the lower member includes a projection having external tabs that are shaped to fit within the helical grooves.

4. The closure of claim 3, wherein rotation of the upper member relative to the lower member causes the tabs to move along the helical grooves, which causes the lower member to be raised or lowered relative to the upper member.

5. The closure of claim 1, wherein the lid includes an annular projection having at least one recess and at least one circumferentially extending race adjoining the at least one recess, and wherein the lower member includes at least one boss shaped to fit into the recess and to travel along the at least one race.

6. The closure of claim 5, wherein the lower member is prevented from rotating relative to the lid when the at least one boss is located in the at least one recess and is permitted to rotate relative to the lid when the at least one boss is located in the at least one race.

7. The closure of claim 1, wherein the upper member includes at least one notch and the lower member includes at least one spring arm mechanism having a detent, wherein the detent of the spring arm mechanism is shaped to fit in the notch and thereby cause the lower member to rotate with the upper member, when the detent is located in the notch.

8. The closure of claim 1, wherein the lower member has an upper surface that seals the drinking opening closed in the first position.

9. The closure of claim 8, wherein the upper surface of the lower member is provided by a sealing tab that is pressed against the drinking opening in the first lower member position to seal the drinking opening closed.

10. The closure of claim 1, wherein rotation of the upper member between the first upper member position and an intermediate position causes the lower member to be lowered relative to the lid.

11. The closure of claim 10, wherein rotation of the upper member from the intermediate position to the second upper member position causes the lower member to rotate with the upper member.

12. The closure of claim 1, wherein the upper and lower members are adapted to be decoupled by holding the upper member in the second upper member position and rotating the lower member towards the first lower member position.

13. The closure of claim 1, further comprising a vent in the lid that is closed by the upper member in the first upper member position and that is opened when the upper member is rotated away from the first upper member position.

14. A beverage cup assembly comprising a beverage cup and a closure, the closure comprising:

a lid having an aperture and a drinking opening;

an upper member located, at least partially, on the outside of the lid, the upper member being rotatable between a first upper member position and a second upper member position;

a lower member located, at least partially, on the inside of the lid, the lower member being coupled to the upper member via the aperture and being operable by rotation of the upper member between the first and second upper member positions, the lower member being operable between a first lower member position, in which the lower member closes the drinking opening and a second lower member position in which the drinking opening is unobstructed by the lower member;

wherein rotation of the upper member between the first upper member position and the second upper member position, causes the lower member to be lowered from the first lower member position away from the lid, so that the lower member is spaced from the drinking opening, and then, to be rotated away from the drinking opening to the second lower member position.

* * * * *